US005781109A

United States Patent [19]

Nakajima

[11] Patent Number: 5,781,109

[45] Date of Patent: Jul. 14, 1998

[54] ALARM SYSTEM FOR PREVENTING LOSS OF PERSONAL PROPERTY

[76] Inventor: Shozo Nakajima, 11-3, Shinbori 1-Chome, Niiza-City, Saitama 353, Japan

[21] Appl. No.: 707,748

[22] Filed: Sep. 5, 1996

[51] Int. Cl.[6] ..... G08B 13/14

[52] U.S. Cl. ..... 340/568; 340/539; 340/571; 340/693

[58] Field of Search ..... 340/568, 571, 340/539, 693

[56] References Cited

U.S. PATENT DOCUMENTS 5,396,218 3/1995 Olah ..... 340/539
5,461,365 10/1995 Schlager et al. ..... 340/539

FOREIGN PATENT DOCUMENTS 6119573 4/1994 Japan .

*Primary Examiner*—Glen Swann
*Attorney, Agent, or Firm*—Ladas & Parry

[57] ABSTRACT

An alarm system for preventing loss of personal property, comprises a pair of radio signal transmission/alarm units that each include a sending component having a signal oscillator, and a receiving/alarm component comprising a tuner for selecting a signal from the sending component and receiving the signal as an electrical current, an amplifier for amplifying the signal current, an alarm, and a switcher that switches off the alarm when the amplified signal current is above a prescribed level and switches on the alarm when the amplified signal current does not exceed a prescribed level. The signal transmitted by one sending component is tuned to the receiving/alarm component tuner frequency of the other transmission/alarm unit, and each receiving/alarm component is tuned to the signal frequency of the sending component in the other transmission/alarm unit.

2 Claims, 2 Drawing Sheets

ALARM SYSTEM FOR PREVENTING LOSS OF PERSONAL PROPERTY

BACKGROUND OF THE INVENTION

1. Field of the Invention

The present invention relates to an alarm system for preventing loss of personal property through theft or forgetfulness by sounding an alarm to warn the owner when the property item concerned is being forgotten or stolen, and more particularly to an alarm system that automatically sounds a warning indicating loss of property possession when it does not receive a radio signal from the location of the personal property.

2. Description of the Prior Art

Wallets, purses, card holders, briefcases, secondary bags, passports and umbrellas are some examples of items of personal property that people lose possession of by inadvertently leaving them somewhere or through theft. This can happen when a person uses a wallet and then forgetfully leaves it lying around, or when a pickpocket takes such items from a person's pocket, or when a thief makes off with a briefcase, bag or the like that has been put down by the owner. Thus, what these types of situations have in common is that they are the result of the owner not immediately realizing that the personal items involved are no longer close at hand.

In response, alarm system devices have been developed that receive radio signals emitted by a transmitter. The alarm system receiver is placed in the wallet, purse, briefcase or other such personal possession concerned, while the owner carries the transmitter. If through theft or other such reason the possession becomes separated from the owner, the system receiver sounds the alarm. The intention of sounding the alarm is to warn the owner that he or she is losing possession of the item concerned, and to startle the thief into leaving the possession. However, some of the thieves who specialize in this type of theft carry the same type or model alarm system receiver, which allows them to perpetrate such a theft without triggering the alarm component.

An object of the present invention is to provide a simple, economical alarm system for preventing the loss of personal property items through theft or forgetfulness by sounding an alarm when the item concerned is more than a certain distance from the owner.

SUMMARY OF THE INVENTION

To attain the above object, the present invention provides an alarm system comprising a pair of radio signal transmission/alarm units that each include a sending component having a signal oscillator, and a receiving/alarm component comprising a tuner for selecting a signal from the sending component and receiving the signal as an electrical current, an amplifier for amplifying the signal current; an alarm, and a switcher that switches off the alarm when the amplified signal current is above a prescribed level and switches on the alarm when the amplified signal current does not exceed a prescribed level, wherein the signal of each sending component is tuned to the receiving/alarm component tuner of the other transmission/alarm unit, and each receiving/alarm component is tuned to the signal of the sending component of the other transmission/alarm unit.

With the alarm system having the above configuration, the alarms in both of the radio signal transmission/alarm units are set off if the units become too far apart for each to receive the signal from the other's sending component. This means that even if a thief has a transmitter that prevents the alarm in one unit from going off, an alarm in the other unit is still set off.

As described, the system units each have both a sending component and a receiving/alarm component. The system can work using very weak signals, which are generated by the oscillator of the sending component. As stated, the receiving/alarm component has a tuner, amplifier, switching circuit and alarm. The tuner is for selecting the radio signal produced by the sending component of the other receiving/alarm unit, and converting the signal to an electrical current. The tuner may be a fixed-frequency tuning circuit. The amplifier is for amplifying the received signal current, and may be constituted as a simple transistorized amplification circuit. As long as the amplified current is above a prescribed level, the switching means remains at the Off setting, which keeps the alarm off. The alarm is switch on by the switching means when the current drops to or below the set level. The switching means may be mechanical, or in the form of a transistorized inverter circuit. The alarm is for drawing the attention of the user to the fact that the item concerned is more than a certain distance away. The alarm may be an audible one such as a buzzer or chimes, or an inaudible one such as a vibrator.

An alarm system set consists of two of the above-described receiving/alarm units. The tuning means in the receiving/alarm component of each receiving/alarm unit is set to the frequency of the signal generated by the sending component in the other receiving/alarm unit. That is, the sending components transmit at a mutually different frequency, with the tuning means of one unit being set to the frequency of the other unit. As a result, the alarms in both receiving/alarm units are set off if the two units are separated by more than the prescribed distance.

To use the system, one receiving/alarm unit is carried by the user, in the user's wallet or pocket, for example, and the other unit is attached to the user's briefcase or other such possession. In operation, the sending component of each unit transmits a signal at a prescribed frequency. Thus, the signals from one receiving/alarm unit are picked up by the receiving/alarm component of the other receiving/alarm unit, amplified and sent to the switching means. When the units are close together, the signal current strength is enough for the switching means to keep the alarm off. However, when the units are widely separated, the current strength of the very-low-amplitude signals received by each unit, even after amplification, drops to or below the prescribed level, causing each of the alarms to be switched on by the switching means, thereby drawing the attention of the user to the fact that the item of property concerned is no longer in his or her proximity. As both alarms are activated, the user can establish the location of the briefcase. Moreover, it is highly likely that the alarm will startle the thief into dropping the briefcase, facilitating recovery. Even if the thief uses a transmitter/alarm device that prevents activation of the alarm in the unit on the briefcase, the other unit carried by the user will still sound the alarm, enabling the user to realize that the briefcase is not in immediate proximity.

Further features of the invention, its nature and various advantages will be more apparent from the accompanying drawings and following detailed description of the invention.

DESCRIPTION OF THE PREFERRED EMBODIMENTS

Figure 1:
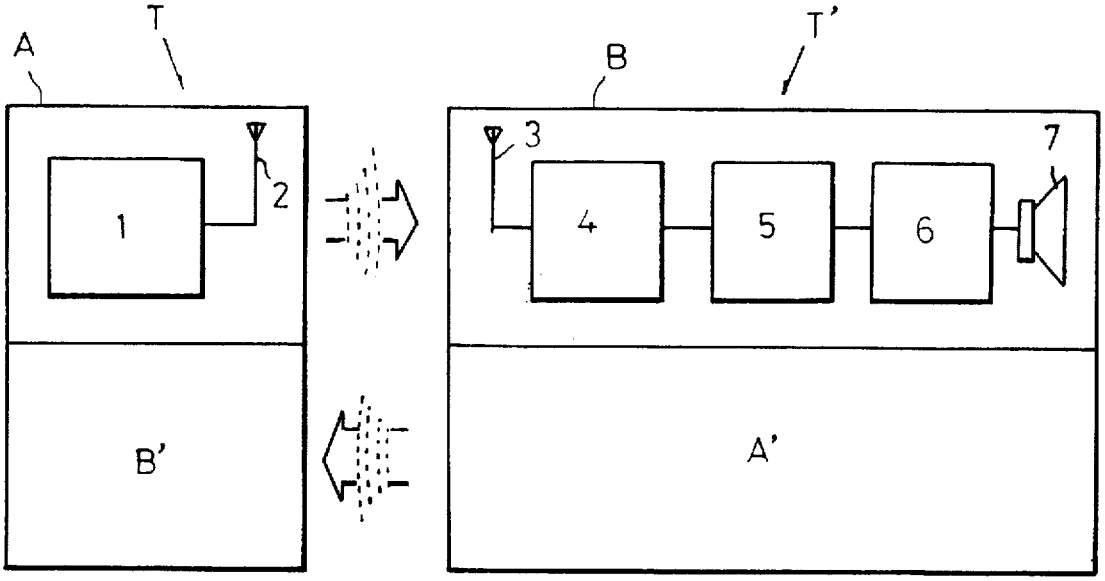
FIG. 1 is a schematic diagram of the alarm system according to the invention.

FIG. 1 illustrates the overall configuration of the alarm system according to the present invention, comprised by a pair of transmission/alarm units T and T'. Transmission/alarm units T and T' are each comprised of a sending component A and A' and a receiving/alarm components B and B'. The sending components A and A' are each equipped with a fixed-frequency signal oscillator 1 and a transmitting antenna 2 for transmitting the signals. The oscillator 1 may be a crystal oscillator or the like. As the signals do not have to carry very far, low-amplitude signal transmission may be used. In nearly all cases there is no need to use an amplifier, but when required, an amplifier may be used to amplify the signals.

The receiving/alarm components B and B' each have an antenna 3 for receiving signals from a sending component A/A', and a tuning circuit 4 tuned to the frequency of the signals from the sending component. The tuning circuit 4 is a fixed frequency type which can be set to the one frequency used by the sending component. An ordinary coil-based tuning mechanism may be used for the tuning circuit 4. In this arrangement, the signals are subjected to induced current conversion. An amplifier 5 is provided to amplify the converted signal current. An ordinary transistorized amplification circuit may be used to constitute the amplifier 5. A switching circuit 6 stays Off when the current amplified by the amplifier 5 exceeds a prescribed level, and switches On when the current does not exceed the prescribed level. The switching circuit 6 may be formed by a transistorized inverter circuit. The switching circuit 6 has an alarm device 7 that emits an alarm when the switching circuit 6 switches On. The alarm device 7 may be one that emits sounds such as a buzz or chimes, or one that produces vibrations.

Figure 2:
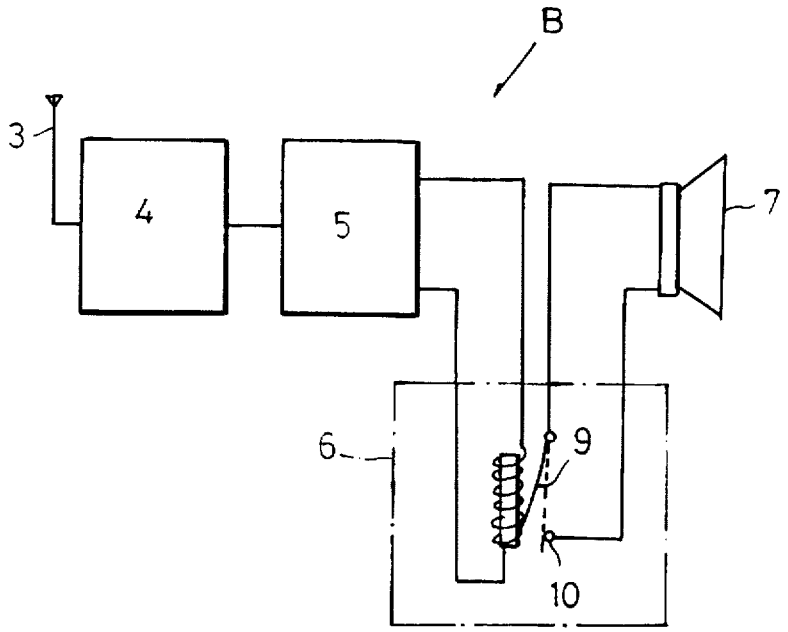
FIG. 2 is a diagram illustrating an embodiment of the system switching arrangement.

An example of a switching circuit 6 configuration is illustrated by FIG. 2. As shown, the switching circuit 6 is provided with an electromagnet 8 wound with a coil through which current from the amplifier 5 flows. A flexible steel strip spring 9 is disposed in proximity to the electromagnet 8, and there is a contact 10 facing the electromagnet 8. The contact 10 and spring 9 are connected to the alarm device 7. When the current amplified by the amplifier 5 is strong enough, the electromagnet 8 generates an electromagnetic force that attracts the strip spring 9. When the current drops below a certain level, the resulting decrease in the electromagnetic force generated by the electromagnet 8 allows the resilience of the strip spring 9 to bring the spring 9 back into contact with the contact 10. This allows current to flow to the alarm device 7, generating an alarm.

Figure 3:
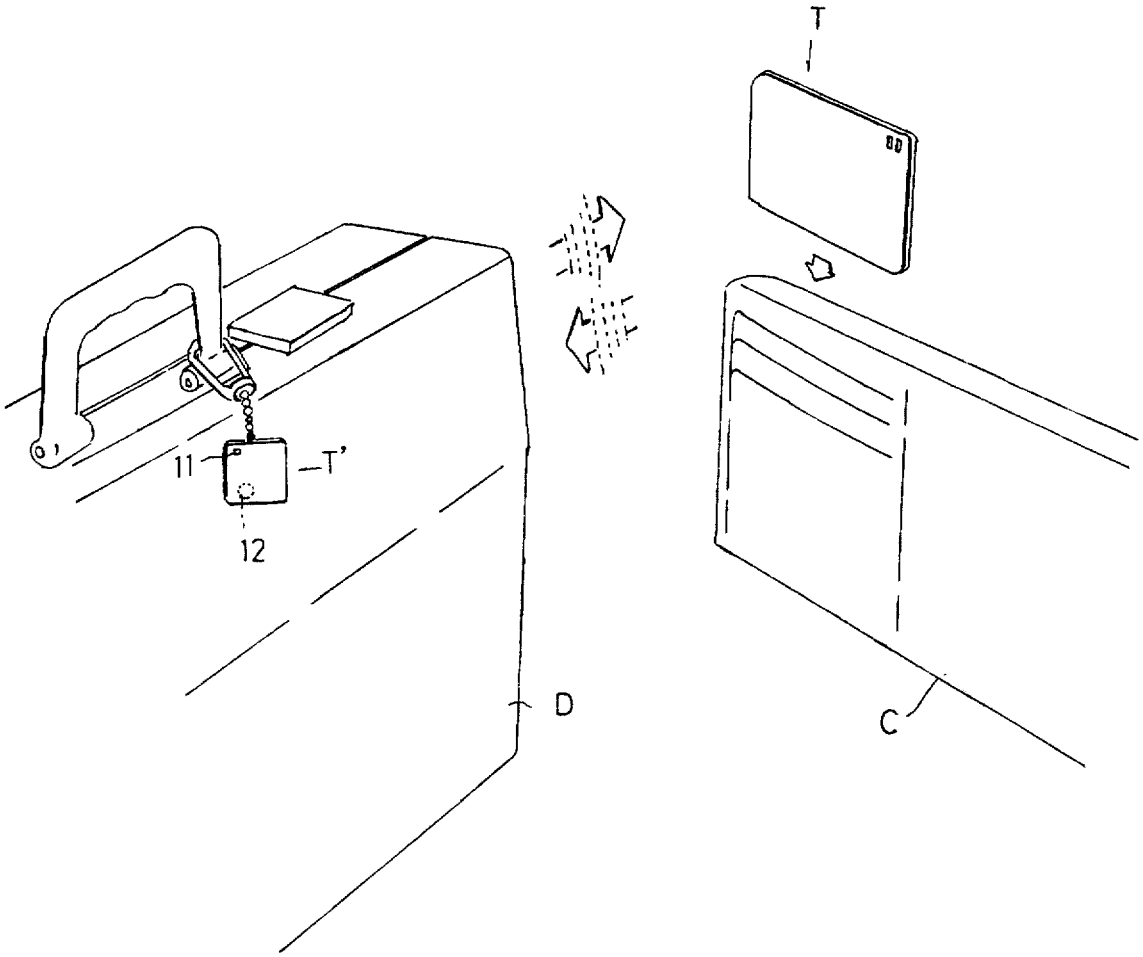
FIG. 3 is a perspective diagram showing the system in use, with one of the transmission/alarm units being carried in a wallet and the other transmission/alarm unit attached to a briefcase.

In the example of system usage shown in FIG. 3, one transmission/alarm unit T is carried in a wallet C. The transmission/alarm unit T is the same shape and size as a credit card, or a cash card issued by a bank, or a prepaid card such as a telephone card. The transmission/alarm unit T is inserted into a card pocket in the wallet C. The other transmission/alarm unit T' is attached to a briefcase D. Transmission/alarm unit T' is about the size of a disposable lighter, and has an On/Off switch 11 on the side. A mercury cell battery 12 in the receiver unit B supplies electrical power to the tuning circuit 4, amplifier 5, switching circuit 6 and alarm device 7. The alarm device 7 is an electronic buzzer.

If the briefcase D is moved away from the owner, such as would happen if it were to be stolen, for example, when the separation reaches the point at which the signals emitted by the transmission/alarm unit T' in the wallet C weaken or are no longer being received, the transmission/alarm unit T on the briefcase D and the transmission/alarm unit T' in the wallet C both emit an alarm, indicating to the owner that the briefcase D is no longer in his or her proximity. Thus, the alarm makes it possible for the owner to immediately act to recover the briefcase D. Even if the thief has the same type of transmission/alarm unit T' , thereby preventing the transmission/alarm unit T' on the briefcase D from sounding an alarm, an alarm will still be sounded by the transmission/alarm unit T' in the wallet C. The transmission/alarm unit T/T' will also sound the alarm if the wallet C is stolen or inadvertently left somewhere.

Thus, the following advantageous effects are obtained with the invention configured as described in the foregoing.

First, the alarm system for preventing loss of personal property comprises a pair of transmission/alarm units, each having a sending component and a receiver/alarm component that emits an alarm if it fails to receive signals from the sending component of the other unit. Accordingly, since the alarm is automatically sounded if the item of property is more than a certain distance away from the owner, the owner can immediately proceed to recover the item concerned, whether the item has been inadvertently left behind through forgetfulness or has been taken by a thief.

Second, the alarm is sounded by both transmission/alarm units. As such, even if a thief has the same type of unit and can thereby prevent the unit attached to the item concerned from emitting an alarm, the owner is still made aware that the item is no longer in his or her proximity by the alarm emitted by the unit carried on his or her person.

Third, all that is needed to activate an alarm is for fixed-frequency, low-amplitude signals to be sent by the sending component and received by the receiving/alarm component. The system therefore has a very simple configuration and can be manufactured at low cost.

Fourth, fabricating a transmitter unit or receiver unit, or both, in a package the size of a credit card enables it to be carried around in a wallet or the like at all times.

What is claimed is:

1. An alarm system for preventing loss of personal property, comprising:

a pair of radio signal transmission/alarm units that each includes a sending component having a signal oscillator; and a receiving/alarm component comprising a tuner for selecting a signal from the sending component and receiving the signal as an electrical current; an amplifier for amplifying the signal current; an alarm; and a switcher that switches off the alarm when the amplified signal current is above a prescribed level and switches on the alarm when the amplified signal current does not exceed a prescribed level;

wherein the signal of each sending component is tuned to the receiving/alarm component tuner of the other transmission/alarm unit, and each receiving/alarm component is tuned to the signal of the sending component of the other transmission/alarm unit.

2. An alarm system according to claim 1 wherein one or both transmission/alarm units is a size and shape of a credit card.

* * * * *